US009234441B2

(12) United States Patent
Root et al.

(10) Patent No.: US 9,234,441 B2
(45) Date of Patent: Jan. 12, 2016

(54) METHOD OF IMMOBILIZING LOW PRESSURE SPOOL AND LOCKING TOOL THEREFORE

(71) Applicant: Pratt & Whitney Canada Corp., Longueuil (CA)

(72) Inventors: Richard Root, Georgetown (CA); Hugo Binette, Toronto (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 486 days.

(21) Appl. No.: 13/792,522

(22) Filed: Mar. 11, 2013

(65) Prior Publication Data

US 2014/0255147 A1 Sep. 11, 2014

(51) Int. Cl.

| | |
|---|---|
| ***F01D 21/00*** | (2006.01) |
| ***F01D 25/28*** | (2006.01) |
| ***F01D 25/00*** | (2006.01) |

(52) U.S. Cl.

CPC ..... *F01D 25/285* (2013.01); *F01D 25/002* (2013.01); *F05D 2230/72* (2013.01)

(58) Field of Classification Search

CPC ..... F01D 21/00; F01D 21/003; F01D 21/006; F01D 25/002; F01D 25/24; F01D 25/285; F01D 17/02; F02C 7/00; F02C 7/32; B64C 11/002; B64C 27/322; F05D 2230/72; F05D 2260/02; F05D 2260/80; F05D 2260/83; F05D 2260/90

USPC ..... 415/1, 12, 118, 122.1, 123, 232; 416/1, 416/14, 46, 140, 61, 62, 152, 169 R, 169 A, 416/248

See application file for complete search history.

(56) References Cited

U.S. PATENT DOCUMENTS

| | | | | |
|---|---|---|---|---|
| 4,196,020 | A * | 4/1980 | Hornak | B08B 3/02 134/167 R |
| 5,868,860 | A * | 2/1999 | Asplund | B08B 3/02 134/22.1 |
| 6,630,198 | B2 * | 10/2003 | Ackerman | B08B 3/02 427/230 |
| 7,445,677 | B1 * | 11/2008 | Asplund | B08B 3/02 134/134 |
| 7,497,220 | B2 | 3/2009 | Asplund et al. | |
| 7,815,743 | B2 | 10/2010 | Asplund et al. | |
| 8,206,111 | B2 | 6/2012 | Aarhus et al. | |
| 9,034,111 | B2 * | 5/2015 | Dorshimer | B08B 3/02 134/34 |
| 9,038,399 | B2 * | 5/2015 | MacFarlane | F02C 7/14 60/782 |
| 2007/0298931 | A1 * | 12/2007 | Trumper | F01D 21/006 477/92 |
| 2008/0040872 | A1 * | 2/2008 | Hjerpe | B08B 3/02 15/3 |
| 2008/0087301 | A1 * | 4/2008 | Lee | B08B 3/02 134/18 |
| 2008/0178909 | A1 * | 7/2008 | Alvestig | B08B 3/02 134/18 |
| 2009/0015011 | A1 * | 1/2009 | Colin | F01D 15/10 290/52 |
| 2009/0084411 | A1 * | 4/2009 | Woodcock | B08B 9/00 134/22.18 |

(Continued)

*Primary Examiner* — Thomas Denion
*Assistant Examiner* — Mickey France
(74) *Attorney, Agent, or Firm* — Norton Rose Fulbright Canada

(57) ABSTRACT

A method of immobilizing a low pressure spool assembly including maintaining a body of the locking tool in the annular gas path, attaching a securing portion of the body across an aperture defined through an annular wall delimiting the gas path; positioning a stop connected to the body of the locking tool into a rotary path of a given one of the sets of blades of the low pressure spool assembly; and rotating the high pressure spool assembly thereby biasing a blade of the given set of blades of the low pressure spool assembly against the stop, thereby immobilizing the low pressure spool assembly. A locking tool and a method of performing engine maintenance are also provided.

19 Claims, 6 Drawing Sheets

(56) References Cited

U.S. PATENT DOCUMENTS

2010/0000572 A1* 1/2010 Giljohann ..... B08B 3/02 134/7
2010/0206966 A1* 8/2010 McDermott ..... B05B 1/14 239/590
2011/0146729 A1* 6/2011 Giljohann ..... B08B 3/02 134/33
2011/0167790 A1* 7/2011 Cloft ..... F02K 1/68 602/226.2
2014/0133991 A1* 5/2014 Anderson ..... F01D 5/3015 416/220 R
2014/0260307 A1* 9/2014 Dorshimer ..... F01D 25/002 60/779
2014/0260308 A1* 9/2014 Dorshimer ..... F01D 25/002 60/779
2015/0125305 A1* 5/2015 Duelm ..... F04D 29/023 416/193 A
2015/0204341 A1* 7/2015 Chekansky ..... F01D 17/06 415/170.1

* cited by examiner

METHOD OF IMMOBILIZING LOW PRESSURE SPOOL AND LOCKING TOOL THEREFORE

TECHNICAL FIELD

The application relates generally to the field of gas turbine engines and, more particularly, to a tool and method by which a low pressure spool can be immobilized during engine maintenance.

BACKGROUND OF THE ART

To prevent premature corrosion of the engine components due to the salt contamination, routine desalination washes are usually required, particularly for aircrafts operated or stored close to salt water. Most available wash equipment is designed for engine performance recovery, requiring equipment that is designed to direct a predefined flow rate of cleaning fluid into the core of the engine with the engine running.

Some devices for cleaning a gas turbine engine include several nozzles to be able to clean the blades of the fan and to allow the liquid to penetrate through the fan blades and reach the compressor. Such devices may be costly and the procedure may be labour-intensive.

SUMMARY

In one aspect, there is provided a method of immobilizing a low pressure spool assembly of a gas turbine engine with a locking tool, the gas turbine engine also having a high pressure spool assembly, the high pressure spool assembly and the low pressure spool assembly being independently rotatable around a main axis and each having a plurality of rotors, each rotor having a set of blades extending across a corresponding portion of an annular gas path, the gas turbine engine further having an annular wall delimiting the annular gas path, the method comprising: while maintaining a body of the locking tool in the annular gas path, attaching a securing portion of the body across an aperture defined through an annular wall delimiting the gas path; positioning a stop connected to the body of the locking tool into a rotary path of a given one of the sets of blades of the low pressure spool assembly; rotating the high pressure spool assembly to bias a blade of the given set of blades of the low pressure spool assembly against the stop, thereby immobilizing the low pressure spool assembly.

In another aspect, there is provided a locking tool for immobilizing a low pressure spool of a gas turbine engine, the low pressure spool being rotatable around a main axis of the gas turbine engine and having a plurality of rotors, each rotor having a set of blades extending across a corresponding portion of an annular gas path of the gas turbine engine, the gas turbine engine further having an annular wall delimiting a portion of the annular gas path with a sensor attachment provided for removably receiving a sensor, the sensor attachment having at least one fastener element external to the gas path and an aperture defined through the annular wall of the engine, the locking tool comprising: an adapter portion complementary to the sensor attachment, and being removably fastenable to the sensor attachment, externally to the gas path, via the at least one fastener element, into an operative position; a body portion having a body and a securing portion extending therefrom, the body portion being securable to the adapter portion across the aperture via the securing portion into a locking configuration where the body is secured in the gas path; and a stop extending from the body portion, the stop extending into a rotary path of a given one of the sets of blades of the low pressure spool assembly when the body is secured in the gas path.

In a further aspect, there is provided a method of performing engine maintenance on a gas turbine engine having a sensor attachment provided for receiving a sensor during operation, the sensor attachment having at least one fastener element and an aperture, the aperture being defined through a gas path wall of the engine, the sensor being removably fastenable to the sensor attachment externally to the gas path via the at least one fastener element into a fastened configuration in which a sensing element of the sensor is exposed to the gas path through the aperture, the method comprising: unfastening and removing the sensor from the sensor attachment; fastening an adapter to the sensor attachment, externally to the gas path; introducing a locking tool into the gas path, and securing it to the adapter across the aperture in a locking configuration in which a stop of the locking tool extends into the rotary path of a rotary component of the gas turbine engine; and performing said engine maintenance while the rotary component is prevented from rotation by abutment against the stop of the locking tool in the locking configuration.

DESCRIPTION OF THE DRAWINGS

Reference is now made to the accompanying figures in which.

DETAILED DESCRIPTION

Figure 1:
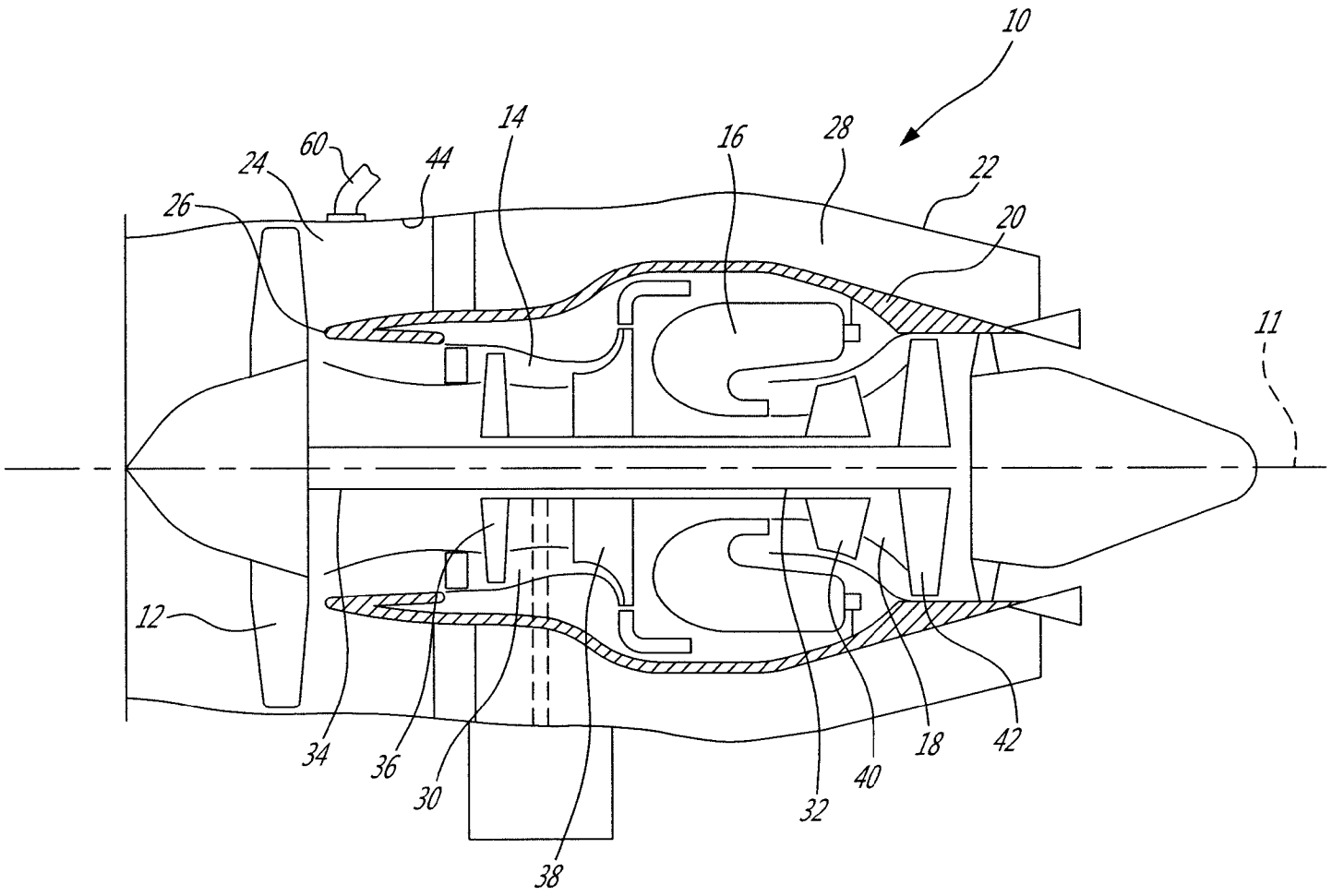
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

In this particular embodiment, the gas turbine engine 10 can be understood to be a turbofan gas turbine engine which has an engine core casing 20 held inside a bypass duct 22, and has an annular gas path 24 which splits into two portions at an edge of the core casing 20, downstream of the fan 12: the outer bypass path 28 and the inner core path 30. The bypass duct 22 forms a radially outer wall of the gas path 24. The core casing 20 rotationally accommodates both a high pressure spool assembly 32 and a low pressure spool assembly 34, each independently rotatable around a main axis 11 of the engine 10. Both the high pressure spool assembly 32 and the low pressure spool assembly 34 include a plurality of rotors, and each one of these rotors has a set of blades extending across a corresponding portion of the gas path 24.

In this particular embodiment, the rotors of the high pressure spool assembly 32 include an axial compressor 36, a centrifugal compressor 38, and a high pressure turbine 40, all of which have blades extending across a corresponding portion of the gas path 24. The rotors of the low pressure spool assembly 34 include a fan 12 and a low pressure turbine 42. The rotors of the high pressure spool assembly 32, together with the combustion chamber 16 and relevant portions of the core casing 20, form the engine core. Corresponding shafts receive the rotors of corresponding spool assemblies. The shaft of the high pressure spool assembly 32 is hollow with the shaft of the low pressure spool assembly 34 extending inside and across it, along the main axis 11. Alternate gas turbine engines can include different configurations of rotors, and can optionally include an intermediate spool assembly, for instance.

Maintenance operations for turbofan gas turbine engines can require immobilizing the fan while an inner turbine stage is rotated, such as is the case for internal desalination, for instance. For the engine core to be desalinated, cleaning liquid must be introduced into the core portion of the gas path as well. If the fan is allowed to rotate, the fan tends to draw the cleaning liquid into the bypass duct rather than the engine core, which negatively affects the desalination efficiency. Some available desalination wash equipment is expensive and is large and bulky, which restricts its possible shipment on an aircraft. Moreover, the process with such equipment is typically long (e.g. more than 8 hours) and labour intensive.

A method proposed herein to desalinate the engine core of the illustrated turbofan engine which in a particular embodiment allows for reduced time, as well as reduced cost and weight of the associated equipment. The method involves rotating the high pressure spool assembly 32, which causes it to draw air into the engine core. The rotating of the high pressure spool assembly 32 can be done using a starter, for instance. The air drawn into the engine core will normally cause the side-effect of exerting a rotary force on the low pressure turbine 42, and accordingly the low pressure spool assembly 34, and therefore drive the fan 12, into rotation.

Figure 2:
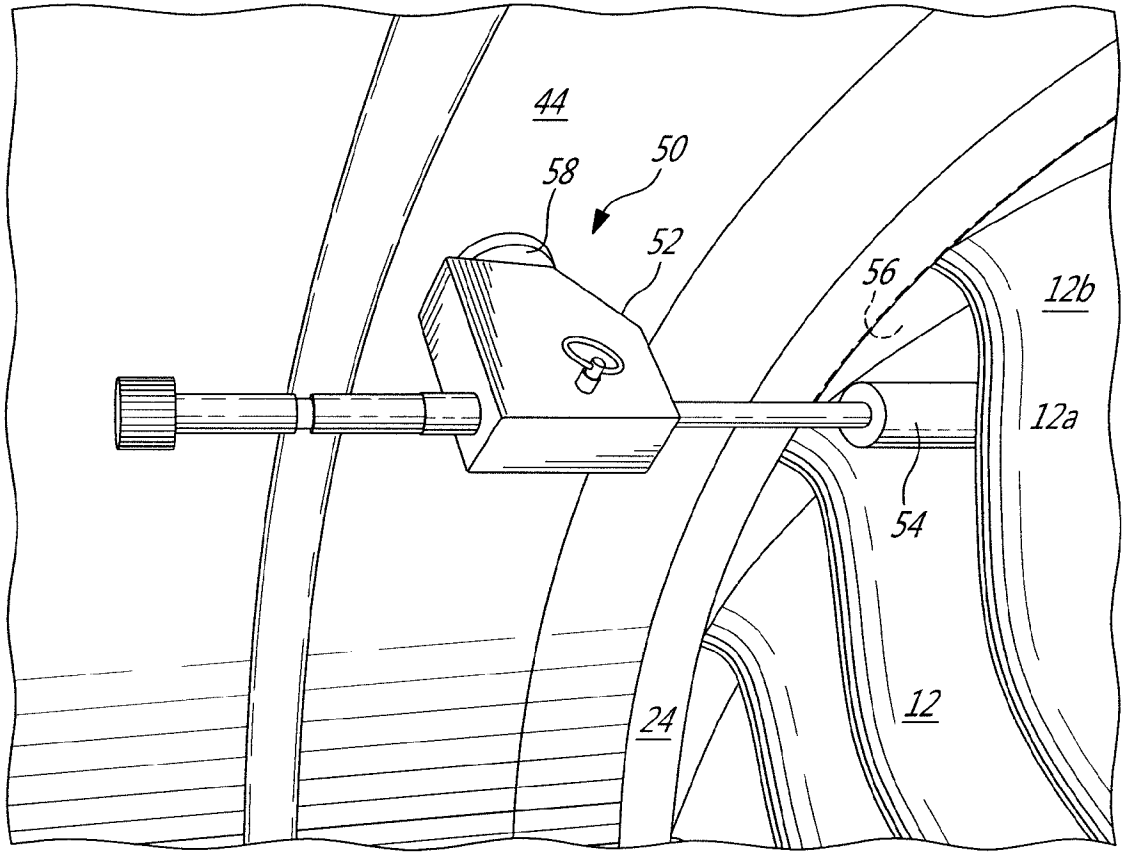
FIG. 2 is a perspective view showing a locking tool secured inside the gas path of a gas turbine engine.

This specification proposes a simple and efficient means by which to immobilize the low pressure spool assembly 34 while the high pressure spool assembly 32 rotates. More specifically, as generally shown in FIG. 2, a locking tool 50 is provided which has a body 52 which can be secured inside the gas path 24 via an aperture in the gas path wall 44 and which has a stop 54 which extends into the rotary path 56 of a corresponding set of blades 12*a* to abuttingly receive a blade 12*b* and prevent the low pressure spool from rotating further, thereby immobilizing it. Moreover, this tool 50 can be secured in the gas path 24 via a sensor aperture 58, simply after having removed the sensor which may be required to be removed during servicing.

Concerning the aperture 58 through which the tool 50 is externally secured, many engine types have at least one removable sensor which is removably attached to the gas turbine engine externally to the gas path, and which has a sensing element which is exposed to the gas path via an aperture provided in the gas path wall. Such sensors can include one or more temperature sensor or one or more pressure sensors, or a combination of temperature and pressure sensors as is often the case in modern gas turbine engines where a temperature sensor and a pressure sensor are combined.

Moreover, the removable sensor is typically removably mounted to the gas turbine engine via a dependable attachment which typically includes at least one, and most likely at least two fastening elements disposed adjacent the aperture, externally of the gas path. The exact type of fastening elements vary from one engine to another, and can include threaded stems extending from the engine and which can be engaged into two apertures in the sensor which can be thereafter firmly held in place by nuts, for instance. Alternately, the fastening elements can include threaded bores into which bolts can be engaged. Other variants are also known to persons skilled in the art.

Figure 3:
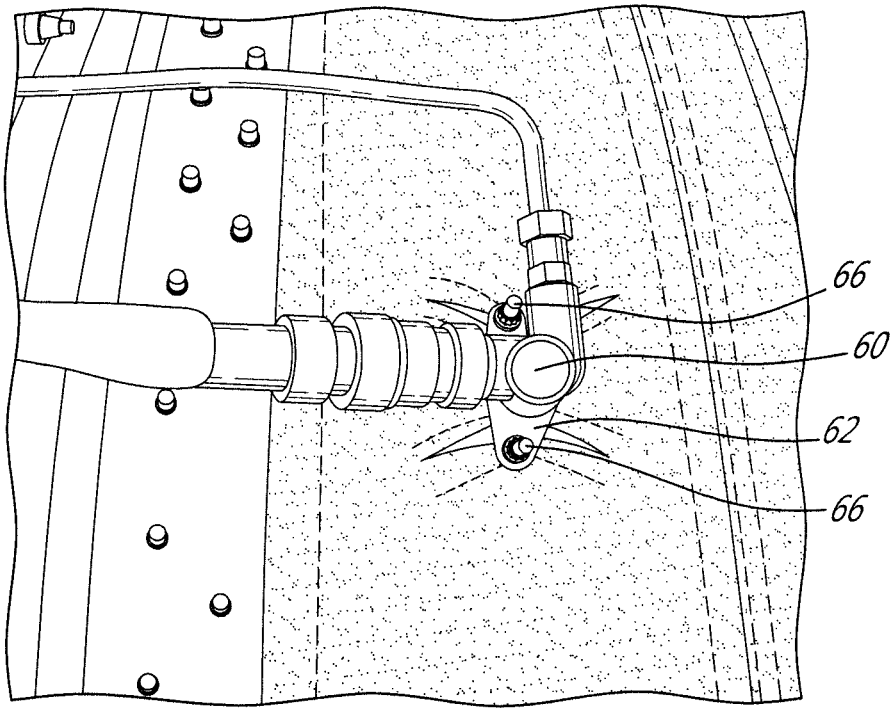
FIG. 3 is a top plan view showing a sensor attached externally to the gas path of the gas turbine engine.

FIG. 3 shows an example of a combined pressure/temperature sensor 60 of a type commonly used on modern engines. In the embodiment shown, the sensor attachment includes two threaded rods 82 (see FIG. 5) which extend radially from the engine and form fastening elements, and the aperture 58 in the gas path being defined therebetween. This specific combined pressure-temperature sensor has a sensor body having a somewhat lozenge shape with the sensing element 64 in the center, alignable with the aperture in the gas path wall, and a bore 66 on both sides, alignable with the threaded rods 82 (see FIG. 5) with which the sensor 60 can be secured into position using nuts.

Figure 4:
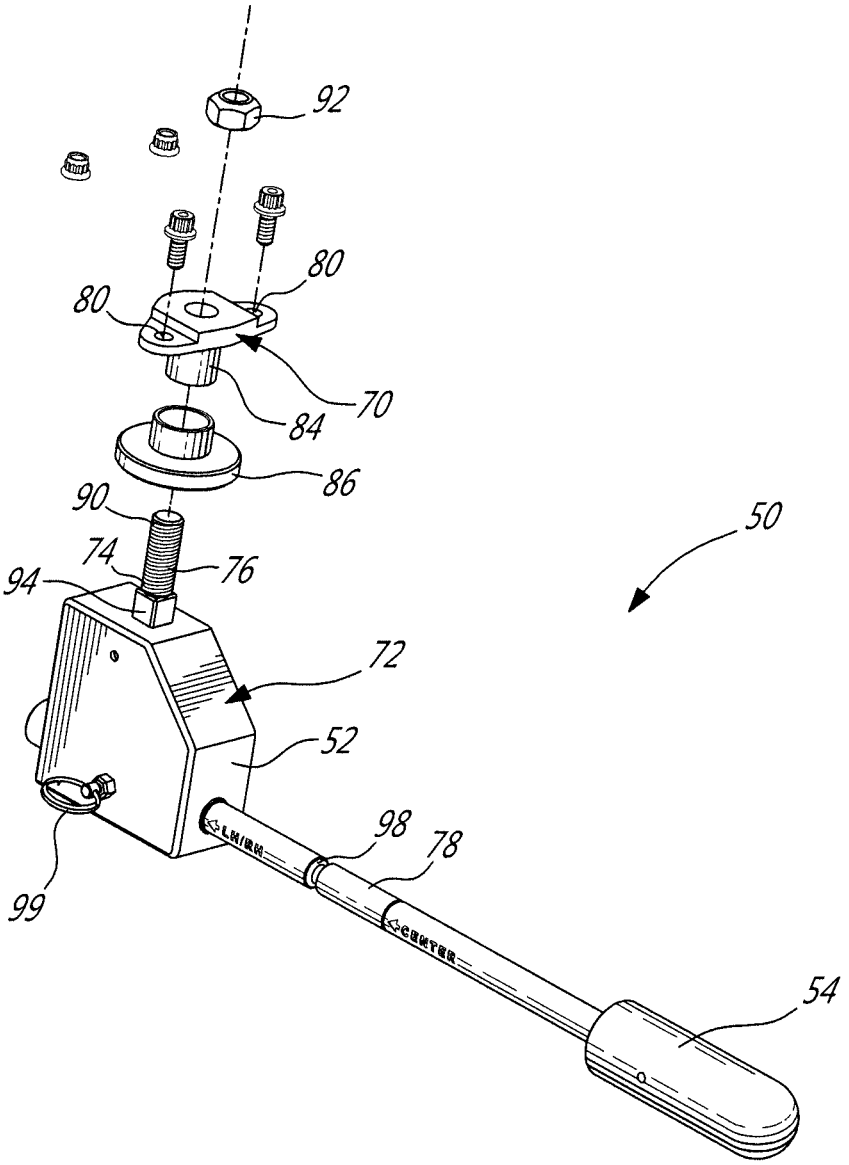
FIG. 4 is an exploded view of the locking tool of FIG. 2.
Figure 5:
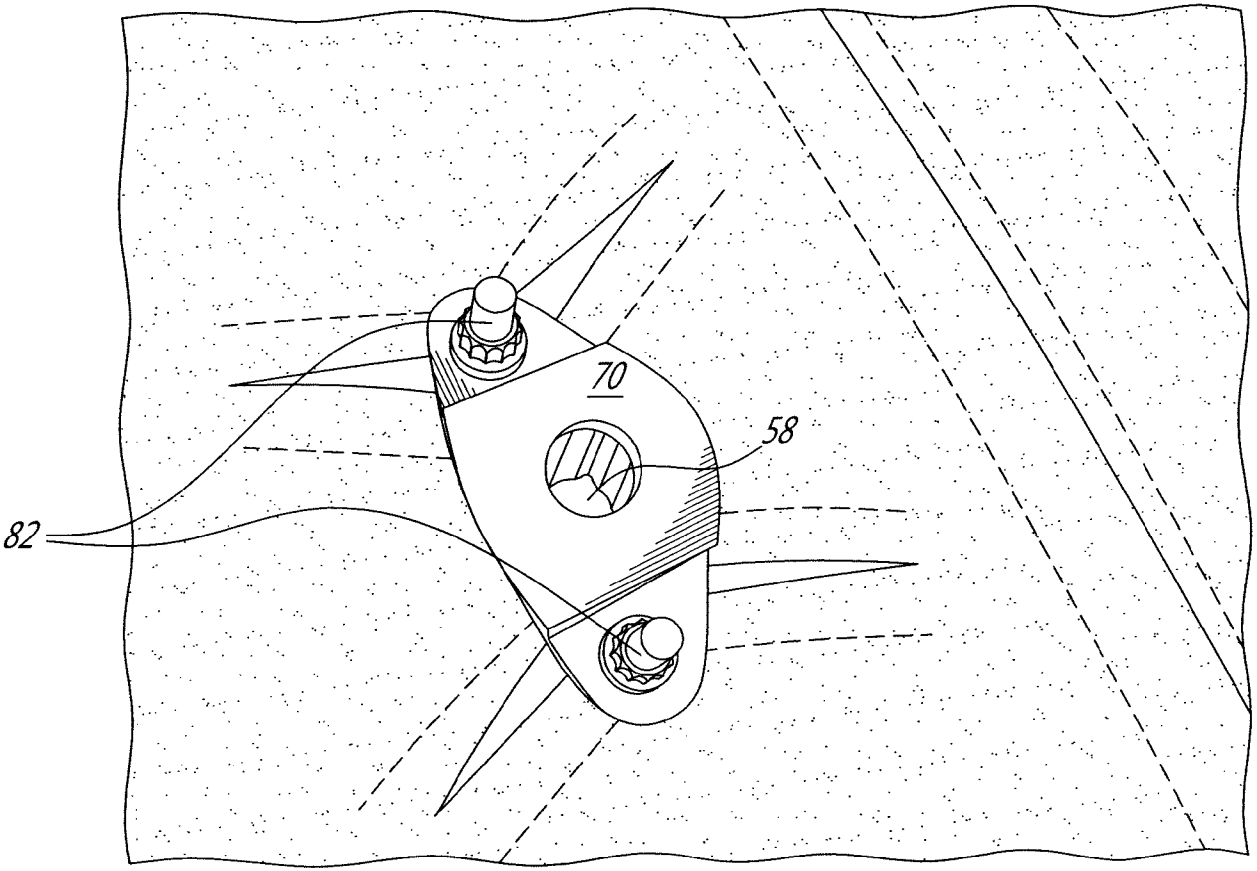
FIG. 5 is top plan view showing an adapter portion of the locking tool secured to the sensor attachment.

FIG. 4 shows an embodiment of a locking tool which is specifically adapted to be mounted to the attachment of the sensor 60 shown in FIG. 3, once the sensor has been removed. In this specific embodiment, the locking tool 50 can be seen to have an adapter portion 70, specifically adapted to be fastenable to the sensor attachment defined by the threaded rods 82, externally from the gas path, such as shown in FIG. 5. The locking tool 50 also has a body portion 72 having body 52 provided in the form of a distinct component, to which a securing member 76 and the stop 54 are mounted. In this specific embodiment, the body 52 is provided in the form of a solid block which has two orthogonal bores: a radial bore in which a post 74 forming the securing portion 76 is mounted, and an axial bore in which an elongated rod 78 leading to the stop 56 is mounted.

To adapt to the specific sensor attachment shown in FIGS. 3 and 5, the adapter portion 70 is also provided with a lozenge shape, having a shape and size similar to that of the sensor body, with two bores alignable with the threaded rods 82 and a protruding hollow neck sized to be received in the aperture 58 in the gas path wall, having a hollow shaped complementary to the shape of the post 74. A bushing 86 is used between the body 52 and the gas path wall 44, to prevent damage to the gas path wall 44 when the body portion 72 is secured to the adapter portion 70 through the aperture 58.

Figure 6:
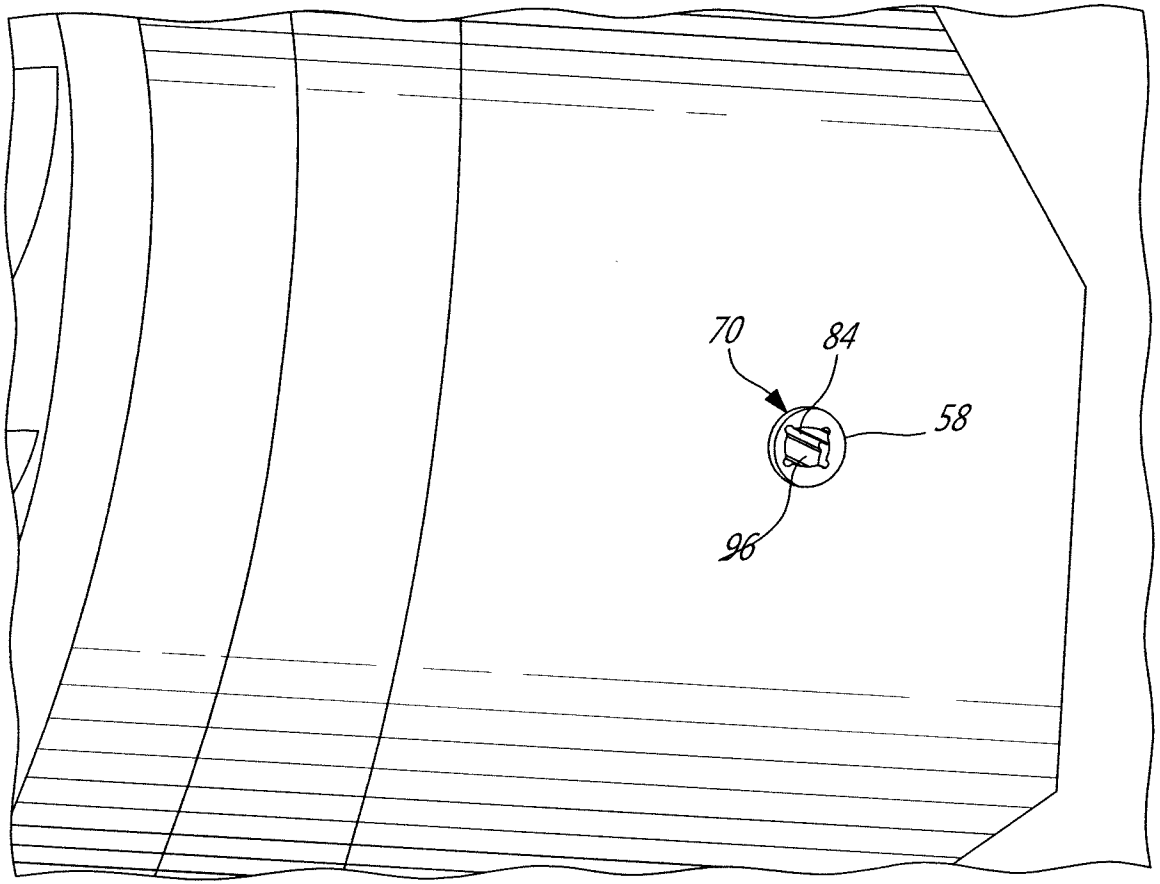
FIG. 6 is a plan view from inside the gas path showing the adapter portion of FIG. 5 partly visible through a sensor aperture.

During use, after removing the sensor 60 from the sensor attachment, the adapter portion 70 is fastened to the sensor attachment in lieu of the sensor as shown in FIG. 5. At this stage, the neck 84 of the adapter portion 70 is exposed to the aperture 58 such as shown in FIG. 6. The body portion 72 can be introduced in the gas path 24, and the post 74 engaged into the bushing 86 and thence into the hollow neck 84 of the adapter portion 70, into the locking configuration shown in FIG. 2. The diameter, or breadth of the post 74 is selected to be engageable into the sensor aperture 58 and offer satisfactory mechanical characteristics, whereas the length of the post 74 is selected for it to have a threaded tip 90 which protrudes from the adapter portion 70, externally to the gas path, and which can be lengthwisely secured to the adapter portion 70 via a nut 92, such as a distortion nut for instance, to secure the body portion 72 in the locking configuration. The nut can offer a certain degree of pivoting resistance around the axis of the post 74, which may be unsatisfactory in some embodiments. Henceforth, in this embodiment, the post 74 is provided with, at its base, a polygonal shape member 94, and a mating polygonal shape aperture 96 (visible in FIG. 6) is provided in the neck 84 of the adapter portion 70 in a manner that the polygonal shape member 94 of the post 74 fits snugly into the mating polygonal shape aperture 96 provided in the neck 84 of the adapter portion 70 to prevent the body portion 72 from pivoting relative to the adapter portion 70 when the nut 92 is fastened to the threaded tip 90 of the post 74. It will be understood that in alternate embodiments, the adapter portion 70 can be adapted to different sensor attachments and other means can be used to prevent the post from pivoting in the adapter portion.

In this specific embodiment, the rod 78 which the stop 54 is mounted to is slidable in the body to different positions corresponding to different axial distances between the axial position of the sensor and the axial position of the corresponding set of blades. In this specific embodiment, two lengthwise positions of the rod are provided for, corresponding to annular grooves 98 defined at predetermined lengthwise positions along the rod 78. A retractable plunger 99 is mounted in a tangential bore provided in the body 52 and is biased to snap into the selected annular groove, and lock the distance between the stop 54 and the body 52, as the selected annular groove is reached during sliding of the rod 78. In alternate embodiments, more positions can be predetermined in order to adapt to differences in the engines. Markings can be used on the rod 78 to assist the user in finding the correct position for a given engine.

A soft material can be selected for the stop 54 to prevent damage to the corresponding set of blades during use of the locking tool 50. In this specific embodiment, a nylon plastic was found satisfactory.

Preferably, the locking tool 50 can be made to be lightweight, in order to control the added load which is represented by the tool, and its transporting case if one is used, when the tool is transported aboard the aircraft. To this end, in a particular embodiment, the body is made of aluminium, and stainless steel is used for the post, the rod, and the adapter, though it will be understood that other materials can be used in alternate embodiments.

Henceforth, using a locking tool such as described herein, the low pressure spool can be immobilized relatively simply, while the high pressure spool is rotated, which can allow desalinating the engine core simply using water from a spray nozzle, for instance, an equipment readily available in many airports.

An example method of desalinating can therefore be performed in accordance with the following. The sensor 60 is removed from the sensor attachment, and the adapter portion 70 is secured to the sensor attachment. The body portion 72 of the tool 50 is introduced inside the gas path 24, and secured to the adapter portion 70 across the sensor aperture 58. Once the body portion 72 is secured to the adapter portion 70, the stop 54 is typically positioned inside the rotation path 56 of the corresponding set of blades 12*a*, and a given one of the blades 12*b* can be positioned into abutment against the stop 54. Any other steps required before cleaning are performed, and the high pressure spool assembly 32 is rotated, drawing air into the engine core which exerts a rotary force on the low pressure spool assembly 34, via the rotors of the low pressure spool assembly 34. The rotary force exerts a biasing force maintaining the given one of the blades 12*a* against the stop 54, thereby immobilizing the low pressure spool assembly 34 while the high pressure spool assembly 32 is rotated. A cleaning fluid is introduced into the engine core; the cleaning fluid can be water from a typical spray hose, for instance, if the ambient temperature is above freezing, or an anti-freezing solution if the ambient temperature is below freezing. The body portion 72 is disassembled from adapter portion 70 and removed from the gas path 24. The adapter portion 70 is disassembled from the sensor attachment and removed. The sensor 60 is reattached to the sensor attachment, and any other steps required after cleaning are performed.

Although the locking tool described herein is particularly well suited for performing desalination maintenance, it will be understood that it can also be used, in identical or adapted form, to perform other maintenance tasks. For instance, it can be desired to immobilize the low pressure spool assembly 34 during noise or vibration analysis maintenance, which may allow the diagnosis of a noise or vibration problem in the high pressure spool assembly 32 without interference from the low pressure spool assembly 34.

The above description is meant to be exemplary only, and one skilled in the art will recognize that changes may be made to the embodiments described without departing from the scope of the invention disclosed. For example, for some alternate engine configurations, it can be practical to position the locking tool adjacent a set of blades from a compressor section, or a turbine section for instance, to immobilize the selected spool, in which case a locking tool such as described herein or specifically adapted can be secured through a suitably positioned sensor aperture, for instance. Still other modifications which fall within the scope of the present invention will be apparent to those skilled in the art, in light of a review of this disclosure, and such modifications are intended to fall within the appended claims.

The invention claimed is:

1. A method of immobilizing a low pressure spool assembly of a gas turbine engine with a locking tool, the gas turbine engine also having a high pressure spool assembly, the high pressure spool assembly and the low pressure spool assembly being independently rotatable around a main axis and each having a plurality of rotors, each rotor having a set of blades extending across a corresponding portion of an annular gas path, the gas turbine engine further having an annular wall delimiting the annular gas path, the method comprising:

while maintaining a body of the locking tool in the annular gas path, attaching a securing portion of the body across an aperture defined through an annular wall delimiting the gas path;

positioning a stop connected to the body of the locking tool into a rotary path of a given one of the sets of blades of the low pressure spool assembly;

rotating the high pressure spool assembly to bias a blade of the given set of blades of the low pressure spool assembly against the stop, thereby immobilizing the low pressure spool assembly.

2. The method as defined in claim 1 further comprising:

removing a sensor from a sensor attachment associated to the aperture;

fastening an adapter portion of the locking tool to the sensor attachment;

wherein attaching the securing portion of the body across the aperture includes attaching the securing portion of the body to the adapter portion.

3. The method as defined in claim 1 wherein said given one of the sets of blades of the low pressure spool assembly is a set of blades of a fan of the gas turbine engine, and wherein the aperture is upstream of the fan.

4. The method as defined in claim 1 further comprising performing maintenance to the gas turbine engine while the high pressure spool assembly is rotated and the low pressure spool is immobilized.

5. The method as defined in claim 4 wherein said performing maintenance includes spraying a cleaning fluid into an engine core of the gas turbine engine associated with the high pressure spool assembly.

6. The method as defined in claim 4 wherein said performing maintenance includes performing at least one of a sound analysis and a vibration analysis on the high pressure spool assembly.

7. The method as defined in claim 1 further comprising, prior to said positioning, adjusting the distance between the stop and the body of the locking tool.

8. The method as defined in claim 1 wherein said attaching further comprises positioning a bushing between the body of the locking tool and the wall of the gas path.

9. The method as defined in claim 1 wherein positioning the stop into the rotary path of the given one of the sets of blades of the low pressure spool assembly includes positioning the stop into the rotary path of a fan of the low pressure spool assembly.

10. A locking tool for immobilizing a low pressure spool of a gas turbine engine, the low pressure spool being rotatable around a main axis of the gas turbine engine and having a plurality of rotors, each rotor having a set of blades extending across a corresponding portion of an annular gas path of the gas turbine engine, the gas turbine engine further having an annular wall delimiting a portion of the annular gas path with a sensor attachment provided for removably receiving a sensor, the sensor attachment having at least one fastener element external to the gas path and an aperture defined through the annular wall of the engine, the locking tool comprising:

an adapter portion complementary to the sensor attachment, and being removably fastenable to the sensor attachment, externally to the gas path, via the at least one fastener element, into an operative position;

a body portion having a body and a securing portion extending therefrom, the body portion being securable to the adapter portion across the aperture via the securing portion into a locking configuration where the body is secured in the gas path; and a stop extending from the body portion, the stop extending into a rotary path of a given one of the sets of blades of the low pressure spool assembly when the body is secured in the gas path.

11. The locking tool as defined in claim 10, wherein the securing portion has a male member having a polygonal cross-section shape, and the adapter portion has a female member having a polygonal cross-section shape complementary to the polygonal cross-section shape of the male member and engaged therewith when in the locking configuration to prevent pivoting of the body portion relative the adapter portion.

12. The locking tool as defined in claim 11, wherein the securing portion has a post with a threaded tip protruding from the male member, and the adapter portion has a complementary bored neck, further comprising a nut securable against the threaded tip opposite the body when in the locking configuration.

13. The locking tool as defined in claim 10 further comprising a rod slidable inside the body and lockable in a plurality of lengthwise positions relative the body, the rod having the stop at an end thereof.

14. The locking tool as defined in claim 10 further comprising a bushing engageable around the securing portion, the bushing being compressed between the body and the wall of the gas path when in the locking configuration.

15. A method of performing engine maintenance on a gas turbine engine having a sensor attachment provided for receiving a sensor during operation, the sensor attachment having at least one fastener element and an aperture, the aperture being defined through a gas path wall of the engine, the sensor being removably fastenable to the sensor attachment externally to the gas path via the at least one fastener element into a fastened configuration in which a sensing element of the sensor is exposed to the gas path through the aperture, the method comprising:

unfastening and removing the sensor from the sensor attachment;

fastening an adapter to the sensor attachment, externally to the gas path;

introducing a locking tool into the gas path, and securing it to the adapter across the aperture in a locking configuration in which a stop of the locking tool extends into the rotary path of a rotary component of the gas turbine engine; and performing said engine maintenance while the rotary component is prevented from rotation by abutment against the stop of the locking tool in the locking configuration.

16. The method as defined in claim 15 wherein performing the engine maintenance includes spraying water into an engine core of the gas turbine engine.

17. The method as defined in claim 15 wherein performing the engine maintenance includes performing at least one of a noise analysis and a vibration analysis.

18. The method as defined in claim 15 further comprising:

subsequently to said engine maintenance, unsecuring the locking tool from the adapter and removing it from the gas path;

unfastening and removing the adapter from the sensor attachment; and fastening the sensor to the sensor attachment into the fastened configuration.

19. The method as defined in claim 15 wherein introducing the locking tool includes securing the locking tool so that the stop extends into the rotary path of a fan of the gas turbine engine.

* * * * *